US010146152B2

(12) United States Patent
Okubo

(10) Patent No.: US 10,146,152 B2
(45) Date of Patent: Dec. 4, 2018

(54) DEVELOPING DEVICE, ASSEMBLY BODY, AND IMAGE FORMING APPARATUS INCLUDING A BLOCKING MEMBER

(71) Applicant: FUJI XEROX CO., LTD., Tokyo (JP)

(72) Inventor: Munenobu Okubo, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/671,294

(22) Filed: Aug. 8, 2017

(65) Prior Publication Data

US 2018/0284642 A1 Oct. 4, 2018

(30) Foreign Application Priority Data

Mar. 30, 2017 (JP) ..... 2017-067845

(51) Int. Cl.
*G03G 15/08* (2006.01)
*G03G 15/00* (2006.01)

(52) U.S. Cl.
CPC ..... *G03G 15/0812* (2013.01); *G03G 15/5054* (2013.01); *G03G 15/0832* (2013.01); *G03G 15/0844* (2013.01)

(58) Field of Classification Search
CPC ..... G03G 15/0898; G03G 15/0942; G03G 15/0815; G03G 15/0889; G03G 15/0891; G03G 15/0893; G03G 21/206
USPC ..... 399/92, 98, 99, 103, 254, 267, 279
See application file for complete search history.

(56) References Cited

U.S. PATENT DOCUMENTS 7,680,426 B2 * 3/2010 Fujimori ..... G03G 15/0942 399/92

FOREIGN PATENT DOCUMENTS

| | | | |
|---|---|---|---|
| JP | 09-054494 | A | 2/1997 |
| JP | 2815987 | B2 | 10/1998 |
| JP | 2002-141738 | A | 5/2002 |

* cited by examiner

*Primary Examiner* — William J Royer
(74) *Attorney, Agent, or Firm* — Sughrue Mion, PLLC

(57) ABSTRACT

A developing device includes a developer holder that holds developer, the developer holder being disposed so as to oppose an image holder that holds a latent image and developing the latent image with the developer; a housing that accommodates the developer holder with the developer holder being exposed from an opening portion; a wall section that is provided over an entire region in an axial direction of the developer holder from an edge portion, which is a downstream side in a rotation direction of the developer holder, of the opening portion of the housing, the wall section having an opposing surface that opposes an outer peripheral surface of the image holder to form a gap; and a blocking member that is disposed on one side of the opposing surface in the axial direction and that blocks part of the gap.

10 Claims, 9 Drawing Sheets

DEVELOPING DEVICE, ASSEMBLY BODY, AND IMAGE FORMING APPARATUS INCLUDING A BLOCKING MEMBER

CROSS-REFERENCE TO RELATED APPLICATIONS

This application is based on and claims priority under 35 USC 119 from Japanese Patent Application No. 2017-067845 filed Mar. 30, 2017.

BACKGROUND

Technical Field

The present invention relates to a developing device, an assembly body, and an image forming apparatus.

SUMMARY

According to an aspect of the invention, there is provided a developing device including a developer holder that holds developer, the developer holder being disposed so as to oppose an image holder that holds a latent image and developing the latent image with the developer; a housing that accommodates the developer holder with the developer holder being exposed from an opening portion; a wall section that is provided over an entire region in an axial direction of the developer holder from an edge portion, which is a downstream side in a rotation direction of the developer holder, of the opening portion of the housing, the wall section having an opposing surface that opposes an outer peripheral surface of the image holder to form a gap; and a blocking member that is disposed on one side of the opposing surface in the axial direction and that blocks part of the gap.

BRIEF DESCRIPTION OF THE DRAWINGS

An exemplary embodiment of the present invention will be described in detail based on the following figures, wherein.

DETAILED DESCRIPTION

An exemplary developing device and an exemplary image forming apparatus according to an exemplary embodiment are described by using FIGS. 1 to 6. An arrow H in the figures denotes a device up-down direction (vertical direction); an arrow W denotes a device width direction (horizontal direction); and an arrow D denotes a device depth direction (horizontal direction).

Overall Structure of Image Forming Apparatus

Figure 3:
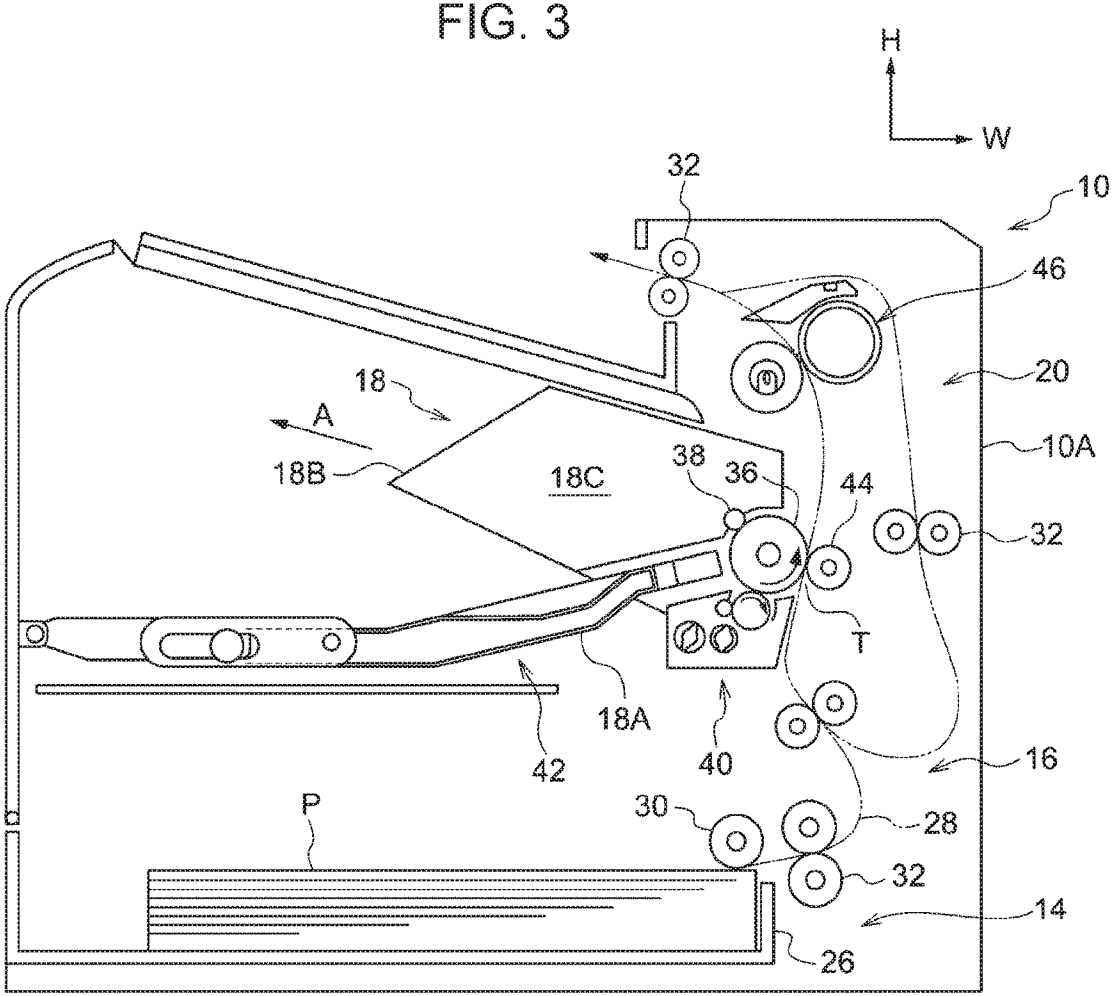
FIG. 3 is a front view of a general layout of an image forming apparatus using the developing device according to the exemplary embodiment.

As shown in FIG. 3, an image forming apparatus 10 according to an exemplary embodiment includes an accommodating unit 14, a transporting unit 16, and an image forming section 20 in that order in an upward direction in the up-down direction (the direction of arrow H). The accommodating unit 14 accommodates sheets P as recording media. The transporting unit 16 transports the sheets P accommodated in the accommodating unit 14. The image forming section 20 forms an image on a sheet P transported from the accommodating unit 14 by the transporting unit 16.

Accommodating Unit

The accommodating unit 14 includes an accommodating member 26 that is capable of being drawn out towards the near side in the device depth direction D from a housing 10A of the image forming apparatus 10. Sheets P are placed on the accommodating member 26. The accommodating unit 14 also includes a feed roller 30 that feeds a sheet P placed on the accommodating member 26 to a transport path 28 of the transporting unit 16.

Transporting Unit

The transporting unit 16 includes transport rollers 32 that transport a sheet P along the transport path 28.

Image Forming Section

The image forming section 20 includes an image forming unit 18 and an exposure unit 42 that are removable from an apparatus body. The image forming unit 18 is an example of an image forming portion that forms a black toner image. The exposure unit 42 is an example of an exposure member that irradiates a photoconductor drum 36 (described below) with exposure light. The image forming section 20 also includes a transfer roller 44 and a fixing device 46. The transfer roller 44 transfers to a sheet P a toner image formed by the image forming unit 18. The fixing device 46 fixes the toner image to the sheet P by heat and pressure. Here, the photoconductor drum 36 is an exemplary image holder.

The image forming unit 18 includes the photoconductor drum 36, a charging roller 38, and a developing device 40. The charging roller 38 charges the surface of the photoconductor drum 36. The developing device 40 makes visible an electrostatic latent image as a toner image by developing the electrostatic latent image. The electrostatic latent image is formed on the photoconductor drum 36 by irradiating the photoconductor drum 36 with exposure light by the exposure unit 42.

Here, the image forming unit 18 includes a lower portion 18A, which includes the developing device 40, and an upper portion 18B, which includes the charging roller 38. The lower portion 18A and the upper portion 18B are connected to each other at both end portions thereof in the device depth direction D. A gap 18C is formed between the lower portion 18A and the upper portion 18B. Part of the exposure unit 42 is disposed in the gap 18C.

By moving the image forming unit 18 in the direction of arrow A in FIG. 3, the image forming unit 18 is removable from the housing 10A.

Operation of Image Forming Apparatus

The image forming apparatus 10 forms an image as follows.

First, the charging roller 38 to which a voltage has been applied uniformly charges the surface of the photoconductor drum 36 to a minus charge with a predetermined potential.

Next, on the basis of externally input data, the exposure unit 42 irradiates the surface of the charged photoconductor drum 36 with exposure light to form an electrostatic latent image.

Accordingly, the electrostatic latent image corresponding to the data is formed on the surface of the photoconductor drum 36. Further, the developing device 40 develops the electrostatic latent image to make it visible as a toner image.

A sheet P that has been fed to the transport path 28 from the accommodating member 26 by the feed roller 30 is fed to a transfer position T where the photoconductor drum 36 and the transfer roller 44 contact each other. At the transfer position T where the photoconductor drum 36 and the transfer roller 44 contact each other, the sheet P is nipped and transported by the photoconductor drum 36 and the transfer roller 44 to transfer the toner image on the surface of the photoconductor drum 36 to the sheet P.

The toner image transferred to the sheet P is fixed to the sheet P by the fixing device 46. Then, the sheet P to which the toner image has been fixed is discharged to the outside of the housing 10A by the transport rollers 32.

Structure of Developing Device

Next, the developing device 40 is described on the basis of FIGS. 1 to 6.

Figure 1:
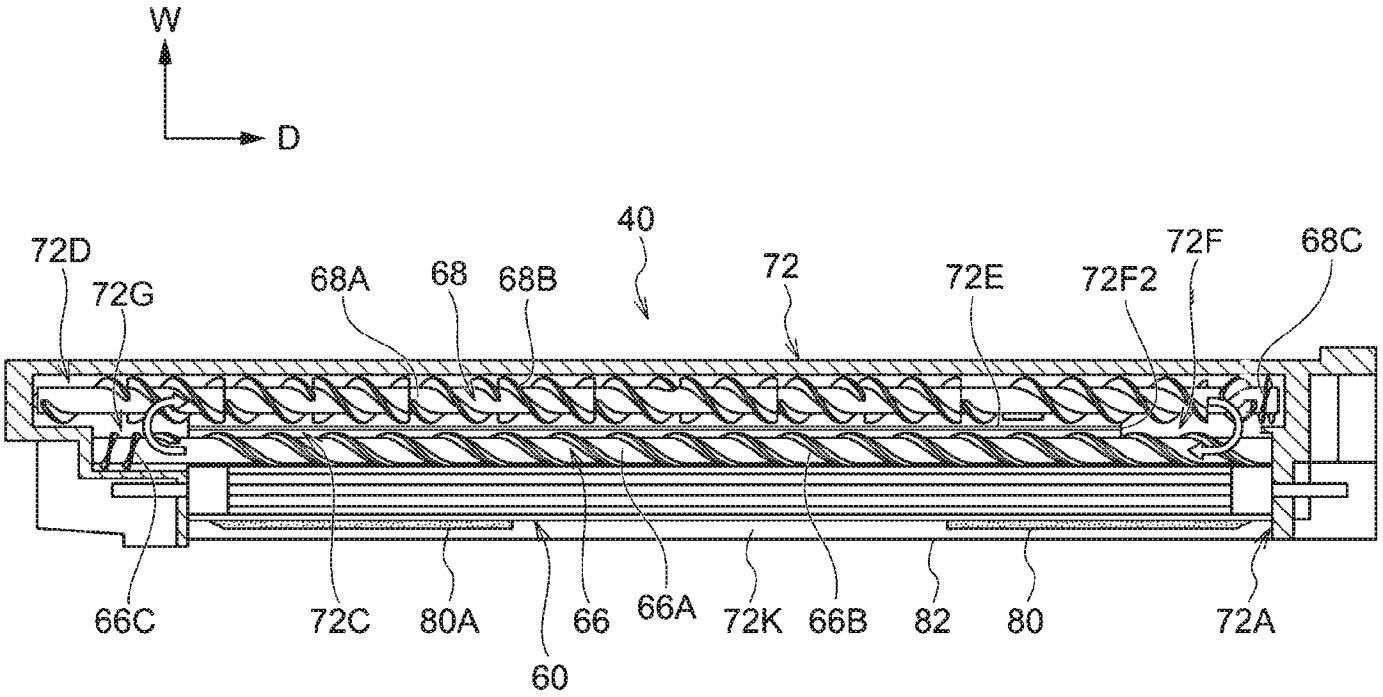
FIG. 1 is a partial sectional plan view of an overall structure of the inside of a developing device according to an exemplary embodiment.

Here, as terms that define the directions of the developing device 40, the near side in the device depth direction D shown in FIG. 1 (left side in the figures) may be called an upstream side of a stirring path portion or a downstream side of a supply path portion as appropriate; and the far side in the device depth direction D in FIG. 1 (right side in the figures) may be called a downstream side of the stirring path portion or an upstream side of the supply path portion as appropriate.

Figure 2:
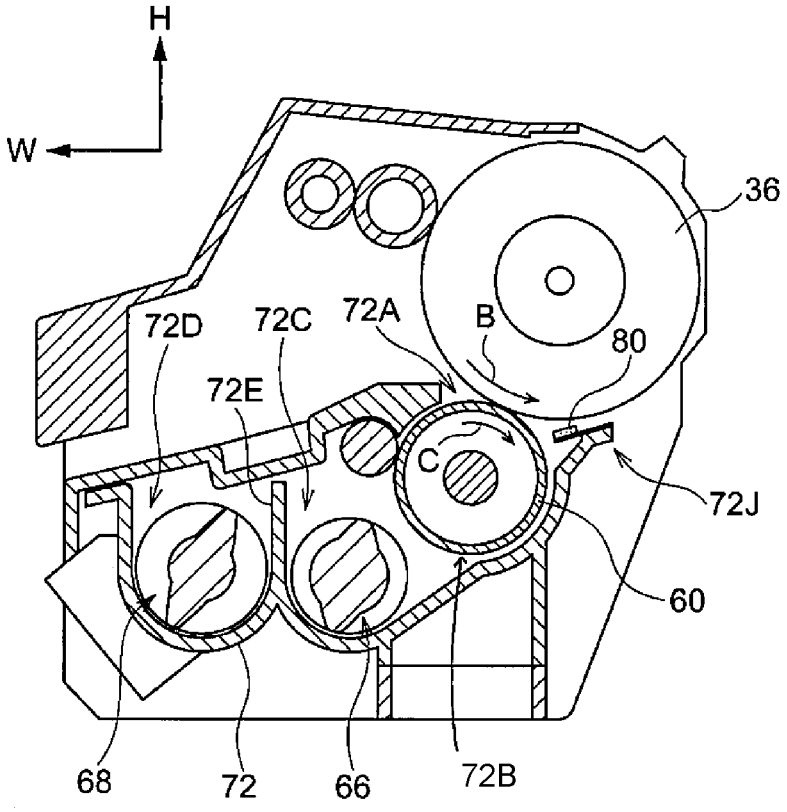
FIG. 2 is a sectional view of the developing device and a photoconductor according to the exemplary embodiment.

As shown in FIGS. 1 and 2, the developing device 40 includes a housing 72, a developing roller 60, a supply auger 66, and a stirring auger 68. The developing roller 60 is disposed so as to oppose the photoconductor drum 36. The supply auger 66 supplies a developer to the developing roller 60. The stirring auger 68 stirs the developer.

Here, the supply auger 66 is an exemplary supplying member, and the stirring auger 68 is an exemplary stirring member.

The developer according to the exemplary embodiment is a two-component developer containing toner, and magnetic carrier particles (hereunder referred to as "the carrier") as principal components.

Housing

As shown in FIGS. 1 and 2, the housing 72 is disposed adjacent to the photoconductor drum 36, and an opening portion 72A that opens into the housing 72 is formed in a portion of the housing 72 facing the photoconductor drum 36. The opening portion 72A extends in the device depth direction D.

A transfer path 72B where the developing roller 60 is disposed is formed on an opposite side of the photoconductor drum 36 with the opening portion 72A interposed therebetween, and extends in the device depth direction D.

A supply path portion 72C where the supply auger 66 (described later) is disposed is formed obliquely below the transfer path 72B, and extends in the device depth direction D.

A stirring path portion 72D where the stirring auger 68 (described later) is disposed is formed on an opposite side of the transfer path 72B with the supply path portion 72C interposed therebetween, and extends in the device depth direction D.

As shown in FIG. 2, wall surfaces that form the supply path portion 72C and the stirring path portion 72D have a U shape in cross section.

In the housing 72, a partition plate 72E that separates the supply path portion 72C and the stirring path portion 72D is formed between the supply path portion 72C and the stirring path portion 72D.

Figure 7:
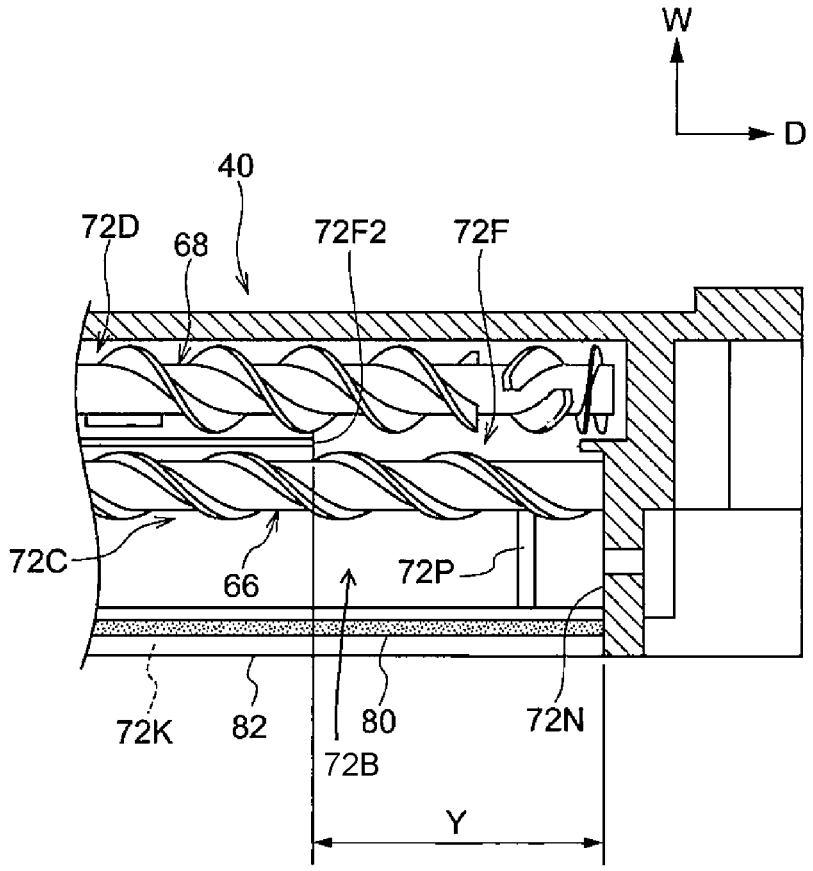
FIG. 7 is a partial sectional plan view of a first modification according to the exemplary embodiment.

As shown in FIG. 7, an upstream wall 72N that defines an upstream-side end portion of the supply path portion 72C is formed on the upstream side of the supply path portion 72C of the housing 72 (right side in FIG. 7).

Supply Path Portion/Stirring Path Portion

As shown in FIG. 1, in the housing 72, the stirring auger 68 is disposed from the upstream side of the stirring path portion 72D (near side in the device depth direction D (left side in FIG. 1)) to the downstream side of the stirring path portion 72D (far side in the device depth direction D (right side in FIG. 1)).

The supply auger 66 is disposed from the upstream side of the supply path portion 72C (far side in the device depth direction D (right side in FIG. 1) to the downstream side of the supply path portion 72C (near side in the device depth direction D (left side in FIG. 1)).

The housing 72 has a replenishing path (not shown) that is formed continuously with the upstream side of the stirring path portion 72D and that replenishes the stirring path portion 72D with toner.

As shown in FIG. 1, in the housing 72, the partition plate 72E is interposed between an upstream-side connecting path 72F and a downstream-side connecting path 72G that connect the stirring path portion 72D and the supply path portion 72C.

Developing Roller

Figure 4:
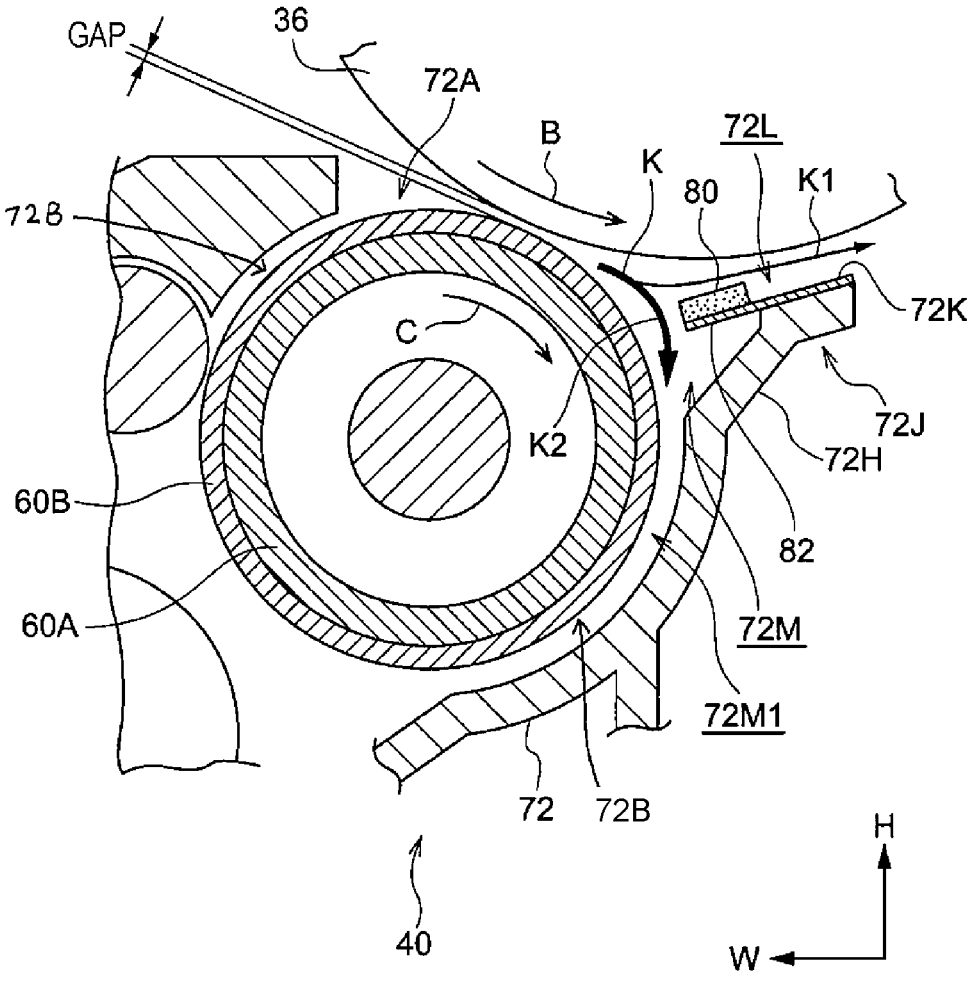
FIG. 4 is a sectional view of a principal portion of the developing device according to the exemplary embodiment.

As described above, the developing roller 60 is disposed in the transfer path 72B. As shown in FIG. 4, a gap (development gap (GAP)) for transferring the developer to the photoconductor drum 36 from the developing roller 60 is formed between the developing roller 60 and the photoconductor drum 36.

The developing roller 60 includes a magnet roller 60A that is circular in cross section and a rotary sleeve 60B that covers the magnet roller 60A and that rotates around the magnet roller 60A.

The rotary sleeve 60B rotates in the direction of arrow C (clockwise) in FIG. 4 due to rotational force that is transmitted to the rotary sleeve 60B from a driving source (not shown).

Figure 6:
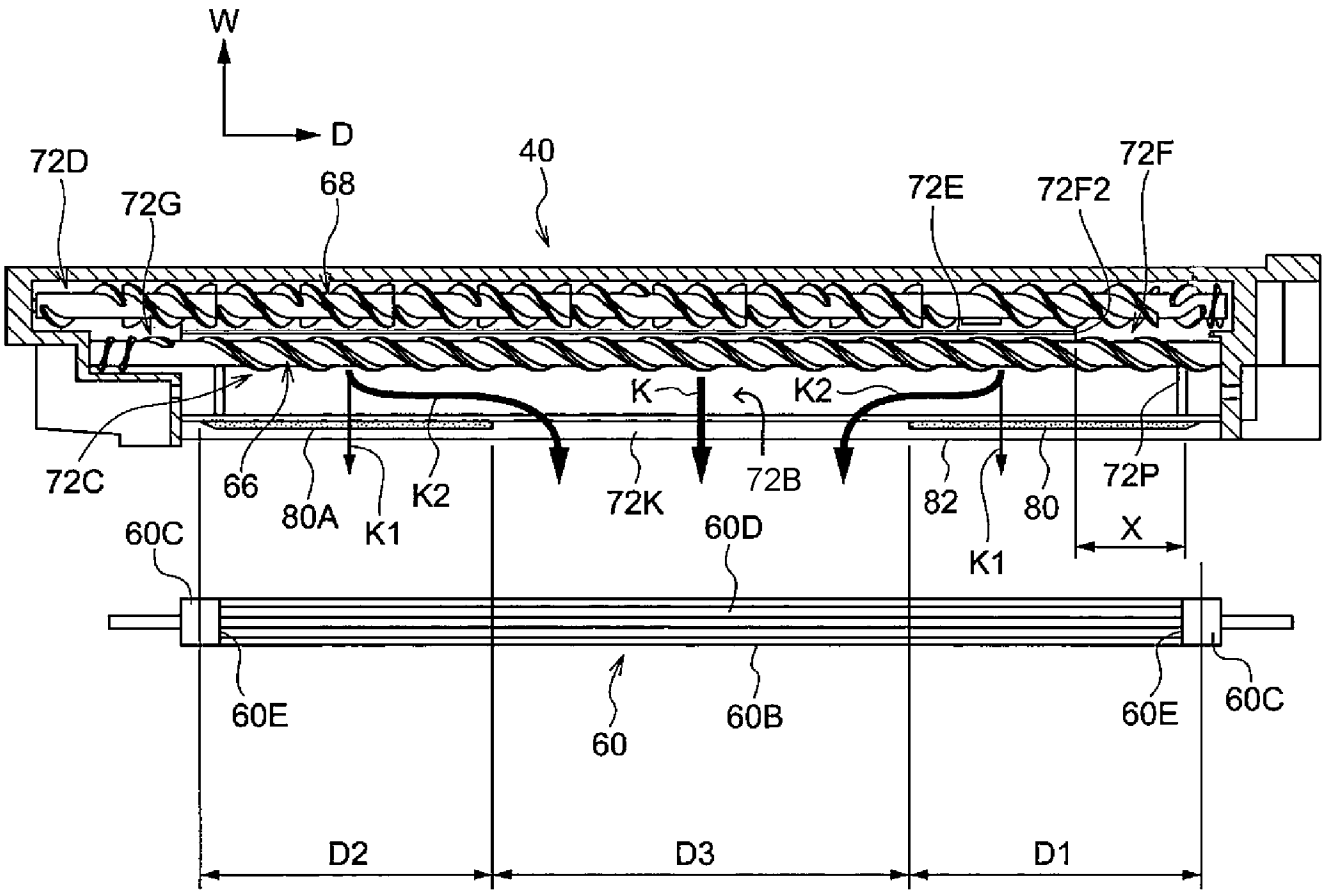
FIG. 6 is a partial sectional plan view of a state in which a developing roller is removed from the developing device according to the exemplary embodiment.

As shown in FIG. 6, the rotary sleeve 60B includes non-development portions 60C and 60C, and a developer holding portion 60D. The non-development portions 60C and 60C are formed on respective end portions of an outer peripheral surface of the rotary sleeve 60B in an axial direction of the developing roller 60. The developer holding portion 60D is interposed between the non-development portions 60C and 60C.

Each non-development portion 60C is continuously formed with the developer holding portion 60D with a corresponding boundary portion 60E therebetween.

Magnetic plates 72P and 72P are provided at a bottom portion of the supply path portion 72C in correspondence with the boundary portions 60E and 60E so as to oppose outer peripheral surfaces of the non-development portions 60C of the rotary sleeve 60B.

When a magnetic field is formed between each magnetic plate 72P and the magnet roller 60A, the developer does not enter locations corresponding to the non-development portions 60C and 60C of the rotary sleeve 60B.

Therefore, the developer does not adhere to the non-development portions 60C and 60C.

Supply Auger

As shown in FIG. 1, the supply auger 66 is disposed in the supply path portion 72C.

The supply auger 66 includes a supply shaft 66A that extends in the device depth direction D, and a spiral supply blade 66B and a spiral circulating blade 66C that are formed on an outer peripheral surface of the supply shaft 66A.

Both end portions of the supply shaft 66A are rotatably supported by wall portions of the housing 72, with a gear (not shown) that transmits rotational force from a driving source being fixed to one of the end portions of the supply shaft 66A.

In this structure, the supply auger 66 that rotates transports the developer in the supply path portion 72C from the upstream side of the supply path portion 72C to the downstream side of the supply path portion 72C while stirring the developer, and supplies the developer to the developing roller 60.

The supply blade 66B and the circulating blade 66C of the supply auger 66 that rotates transfer the developer that has been transported to the supply path portion 72C to the stirring auger 68 in the stirring path portion 72D via the downstream-side connecting path 72G, which is connected to the upstream side of the stirring path portion 72D, at the downstream side of the supply path portion 72C.

Stirring Auger

As described above, the stirring auger 68 is disposed in the stirring path portion 72D (see FIG. 1).

The stirring auger 68 includes a stirring shaft 68A that extends in the device depth direction D, and a spiral stirring blade 68B and a spiral circulating blade 68C that are formed on an outer peripheral surface of the stirring shaft 68A.

Both end portions of the stirring shaft 68A are rotatably supported by wall portions of the housing 72, with a gear (not shown) that transmits rotational force from a driving source being fixed to one of the end portions of the stirring shaft 68A.

The stirring blade 68B is formed on a portion of the stirring shaft 68A that is disposed in the stirring path portion 72D.

The circulating blade 68C is formed on a portion of the stirring shaft 68A that is disposed on the downstream side of the stirring path portion 72D. A portion of the circulating blade 68C faces the upstream-side connecting path 72F, which is connected to the supply path portion 72C. The spiral winding direction of the circulating blade 68C is opposite to the spiral winding direction of the stirring blade 68B.

In this structure, the stirring blade 68B of the stirring auger 68 that rotates transports toner that has flown into the stirring path portion 72D from the replenishing path (not shown) while stirring the developer that has been transferred from the supply auger 66 via the downstream-side connecting path 72G.

More specifically, the stirring blade 68B of the stirring auger 68 that rotates transports the developer from the upstream side to the downstream side of the stirring path portion 72D while stirring the developer.

Further, the circulating blade 68C of the stirring auger 68 that rotates transfers the developer that has been transported by the stirring blade 68B to the supply auger 66 via the upstream-side connecting path 72F so as to hold back the developer.

In this way, the developer circulates between the supply path portion 72C and the stirring path portion 72D (refer to the arrows shown in FIG. 1).

Operation of Developing Device

Next, the operation of the developing device 40 is described.

In the housing 72 of the developing device 40, as shown in FIG. 1, the supply auger 66 that rotates and the stirring auger 68 that rotates circulate the developer between the supply path portion 72C and the stirring path portion 72D while stirring the developer (refer to the arrows in FIG. 1).

By stirring the developer, the toner and the carrier in the developer are rubbed against each other, so that the toner is frictionally charged to a predetermined polarity.

As shown in FIG. 2, by the supply auger 66 that rotates, the developer is supplied to the developing roller 60, and is held in a state in which a magnetic brush (not shown) is formed on the surface of the developing roller 60 by magnetic force of the magnet roller 60A.

Then, the rotary sleeve 60B that rotates transports the developer.

The rotary sleeve 60B that rotates transports the developer to a location opposing the photoconductor drum 36.

The toner of the developer that has been transported to the location opposing the photoconductor drum 36 adheres to an electrostatic latent image formed on the photoconductor drum 36, and develops the electrostatic latent image as a toner image.

In the developing device 40, a controller (not shown) receives information about a reduction in the amount of toner in the developer, that circulates between the supply path portion 72C and the stirring path portion 72D from a detector (not shown).

The controller causes toner accommodated in a toner cartridge (not shown) to flow into the stirring path portion 72D via a replenishing port (not shown).

In this way, the developing device 40 supplies the developer for forming an image on a sheet P to the photoconductor drum 36.

Structure of Principal Portions

Housing/Blocking Members

Blocking members, which are principal portions according to the exemplary embodiment of the present invention, are described.

Housing

As shown in FIGS. 1 and 2, as described above, the housing 72 has the opening portion 72A where part of the developing roller 60 is exposed.

A wall section 72J is provided at the opening portion 72A over the entire region in the axial direction of the developing roller 60 from an edge portion 72H, which is a downstream side in the rotation direction C of the developing roller 60. The wall section 72J has an opposing surface 72K that opposes the outer peripheral surface of the photoconductor drum 36 to form a gap 72L.

One side of the gap 72L is connected to the outside of the developing device 40, and the other side of the gap 72L is connected to a space 72M described below.

Figure 5:
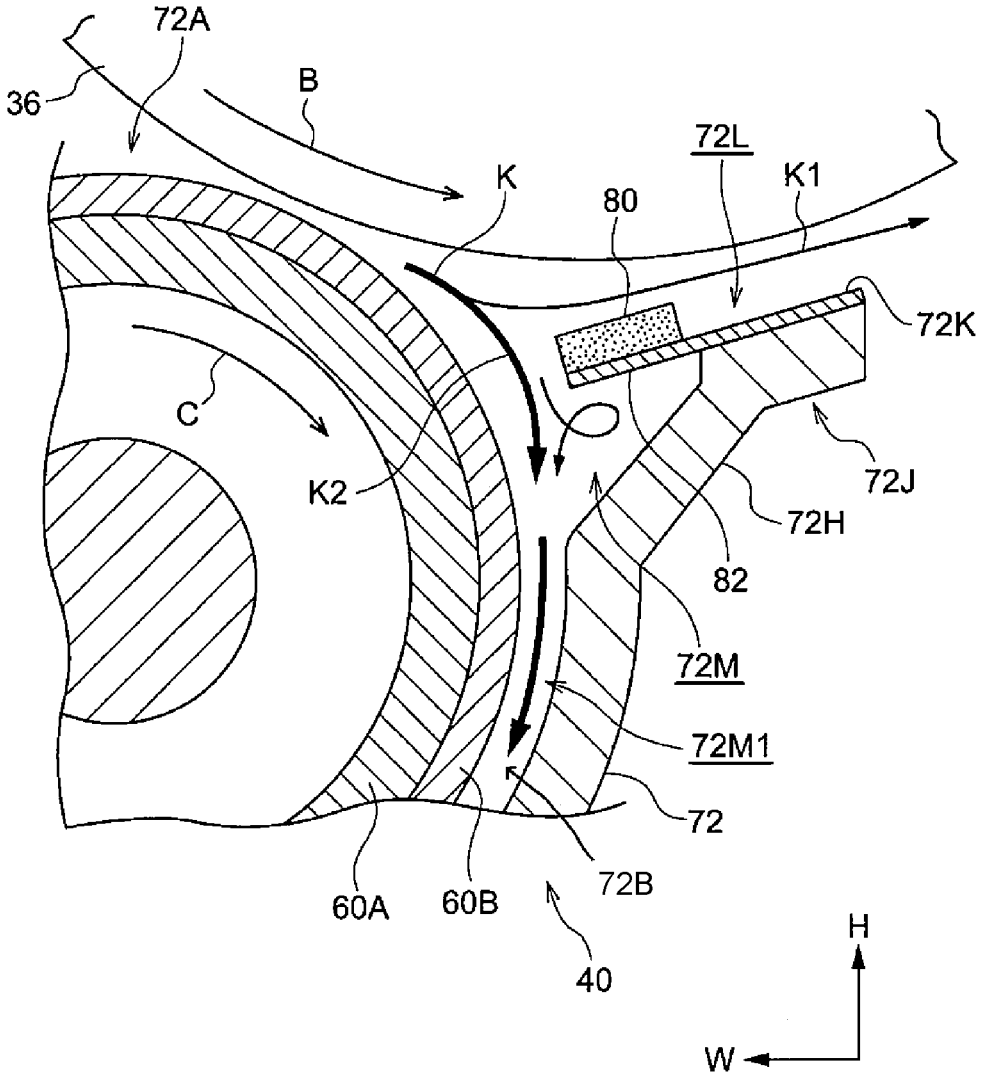
FIG. 5 is an enlarged view of the principal portion in the section in FIG. 4.

As shown in FIGS. 4 and 5, the space 72M that is surrounded by the photoconductor drum 36, the developing roller 60, and the edge portion 72H is formed on an edge-portion 72H side of the opening portion 72A.

The edge-portion 72H side of the space 72M is connected to the other side of the gap 72L, and is connected to the outside of the developing device 40 via the gap 72L.

A gap 72M1 is connected to the space 72M, and is formed between the developing roller 60 and the housing 72 extending along the outer peripheral surface of the developing roller 60 on a downstream-side thereof in the rotation direction thereof.

Blocking Members

The housing 72 is provided with a blocking member 80.

The blocking member 80 is disposed on one side of the opposing surface 72K in the axial direction of the developing roller 60, and blocks part of the gap 72L.

In the exemplary embodiment, as shown in FIG. 1, the blocking member 80 and a blocking member 80A are provided apart from each other on the opposing surface 72K so as to be positioned on the upstream side of the supply path portion 72C and on the downstream side of the supply path portion 72C, respectively, in the axial direction of the developing roller 60.

More specifically, as shown in FIG. 6, the blocking member 80 and the blocking member 80A are provided in a region D1 corresponding to the upstream side of the supply path portion 72C and a region D2 corresponding to the downstream side of the supply path portion 72C, respectively; and are not provided in a central region D3 interposed between the regions D1 and D2.

The blocking member 80 in the region D1 is provided in correspondence with a range X corresponding to part of the upstream-side connecting path 72F.

In the exemplary embodiment, the region D3 is set to a size that is smaller than the size of a smallest sheet P where the performance of the image forming apparatus 10, such as image formation, is guaranteed (guaranteed smallest paper size) among the sizes of sheets P in the axial direction of the developing roller 60 used in image formation.

Therefore, the dimension of the region D3 is a dimension that is set as appropriate considering, for example, the size and performance of the image forming apparatus 10.

The blocking member 80 is made of an elastic material that is softer than the outer peripheral surface of the photoconductor drum 36. More specifically, PORON (trademark), made of urethane foam, is used for the blocking member 80.

As shown in FIG. 4, the opposing surface 72K includes the wall section 72J and a blocking plate 82 that is fixed to the wall section 72J and that projects into the space 72M.

In the exemplary embodiment, the wall section 72J and a blocking plate 82 are exemplary wall sections.

In the exemplary embodiment, the blocking member 80 is provided on a surface of a portion of the blocking plate 82 projecting into the space 72M, the surface facing the outer peripheral surface of the photoconductor drum 36.

Operations of Principal Portions

Here, the operations of the principal portions are described with reference to FIGS. 4 to 6.

As shown in FIG. 5, as described above, the structure of the opening portion 72A of the housing 72 of the developing device 40 includes the blocking member 80 on the opposing surface 72K including the wall section 72J.

As a result of disposing the blocking member 80 on the opposing surface 72K, part of the gap 72L is blocked by the blocking member 80.

This takes into consideration the fact that the number of cloud particles, produced in the developing device 40, that is discharged from the opening portion 72A of the developing device 40 is larger on the upstream side of the supply path portion 72C than at other portions. Here, the cloud particles are particles including toner particles floating in the air.

More specifically, the developer transported while being stirred in the stirring path portion 72D changes its transport direction via the upstream-side connecting path 72F.

When the developer whose transport direction has been changed is transferred to the supply auger 66 along the supply path portion 72C, the number of cloud particles that moves towards the gap 72L becomes large due to an increase in a violent movement of the developer and rippling of a liquid surface.

The aforementioned gap 72L is positioned beyond the upstream-side connecting path 72F in the transport direction of the developer.

Therefore, the number of discharged cloud particles in the region corresponding to the upstream-side connecting path 72F (the region D1 in FIG. 6) is larger than that in the region corresponding to the downstream-side connecting path 72G (the region D2 in FIG. 6).

Therefore, the blocking member 80 is provided on the upstream side of the supply path portion 72C, so that, at a portion where the number of cloud particles is large in the axial direction of the developing roller 60, part of an air current K that is discharged to the outside of the developing device 40 is moved to the central region D3 (see FIG. 6).

This makes it possible to reduce the number of cloud particles that is discharged to the outside of the developing device 40, and to suppress contamination of the inside of the image forming apparatus 10 and contamination of an image formed on a sheet P.

Figure 9:
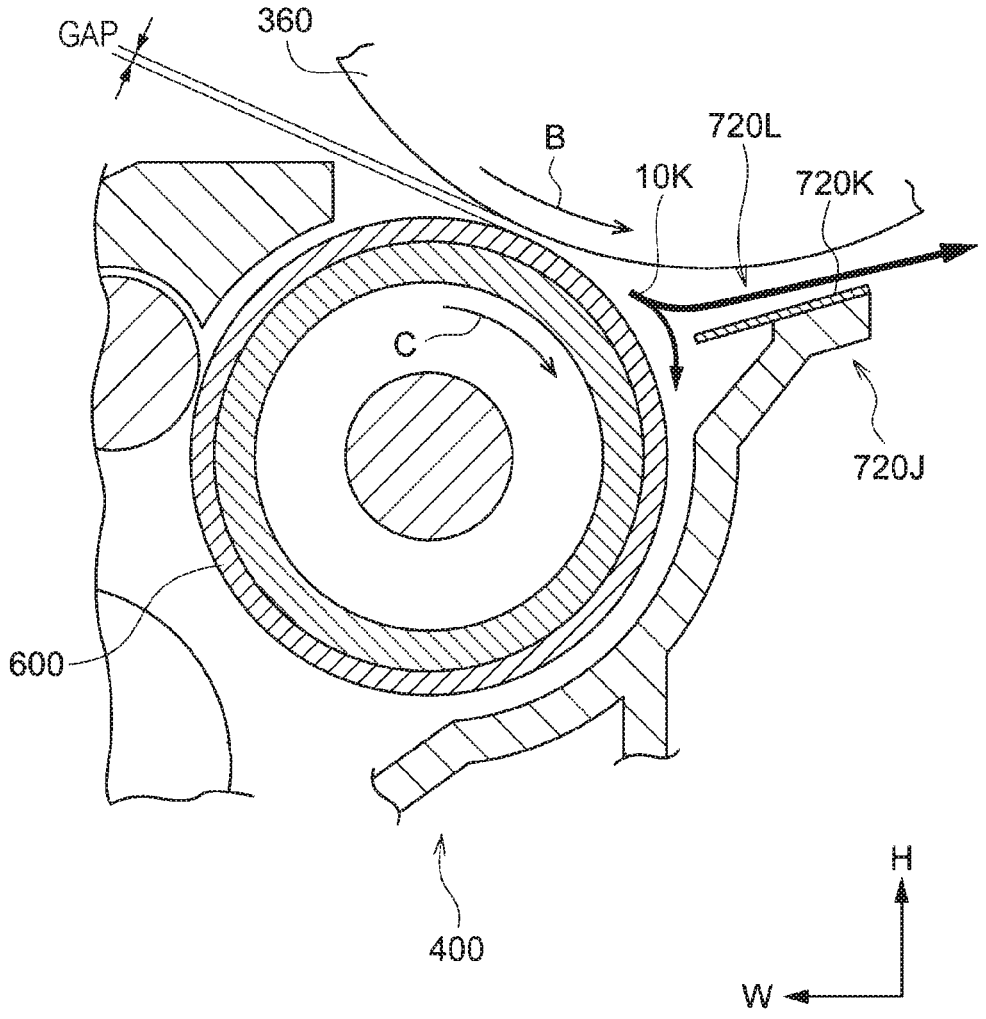
FIG. 9 is a conceptual sectional view of a state of air flow in a developing device according to a comparative example.

On the other hand, as shown in FIG. 9, in a developing device 400 according to a comparative example, since a blocking member is not provided on an opposing surface 720K including a wall 720J, a gap 720L has a constant size in an axial direction of a developing roller 600.

Therefore, the amount of air current 10K that flows along the opposing surface 720K towards the outside of the developing roller 600 is constant in the axial direction of the developing roller 600, the air current 10K being produced by the rotation of a photoconductor drum 360 in the direction of arrow B and the rotation of the developing roller 600 in the direction of arrow C.

Here, as mentioned above, the number of cloud particles, produced in the developing device 400, that is discharged from an opening portion 72A of the developing device 400 is larger on the upstream side of the supply path portion 72C than at other portions.

In the upstream-side connecting path 72F, the amount of air current and the number of cloud particles are large. Therefore, the degree of contamination of the inside of the image forming apparatus and the degree of contamination of an image formed on a sheet P are high.

In contrast, in the developing device 40 according to the exemplary embodiment, at a portion where the blocking member 80 is provided, the air current K passes through the gap (GAP), which is formed when the outer peripheral surface of the photoconductor drum 36 and the developing roller 60 are disposed close to each other, and flows into the space 72M.

The air current K that has flown into the space 72M is divided into an air current K1 and an air current K2. While colliding with the blocking member 80, the air current K1 flows through the gap 72L and is discharged to the outside of the developing device 40. The air current K2 collides with the blocking member 80 and flows through the space 72M in the direction of the central region D3 where the blocking member 80 is not provided.

Part of the air current K2 changes its direction of flow so as to be drawn towards the central region D3, flows through the gap 72L at the central region D3, and flows out to the outside of the developing device 40.

Here, the relationship between the cloud particles that are produced in the developing device 40 and each current flow is described.

The cloud particles that are produced in the developing device 40 move on the air current K shown in FIGS. 4 and 5 and move towards the space 72M.

Some of the cloud particles that have moved to the space 72M move onto the air current K1, and are discharged to the outside of the developing device 40 via the gap 72L. Since the amount of air current is small, contamination caused by the cloud particles on the side of the upstream-side connecting path 72F is reduced.

On the other hand, the cloud particles that have moved onto the air current K2 are, along with the air current K2, drawn into the gap 72M1 while swirling in a region below the blocking plate 82 that projects into the space 72M.

However, the amount of air current K2 that is drawn into the gap 72M1 is small. As shown in FIG. 6, most of the air current K2 flows through the space 72M towards the central region D3.

While the air current K2 flows through the space 72M, the cloud particles on the air current K2 are captured by the carrier remaining in the space 72M, and some of the cloud particles are drawn into the gap 72M1 and return to the inside of the developing device 40.

Further, the cloud particles that are not drawn into the gap 72M1 remain on the air current K2, and are discharged from the central region D3 interposed between the blocking members 80 and 80A.

Accordingly, the cloud particles are captured by the carrier existing in the gap 72M while the cloud particles are drawn into the central region D3 at the opposing surface 72K in the space 72M, so that it is possible to reduce the number of cloud particles that is discharged to the outside of the developing device 40.

This makes it possible to suppress contamination of the inside of the image forming apparatus 10 and contamination of an image formed on a sheet P.

The blocking members 80 and 80A are made of an elastic material that is softer than the outer peripheral surface of the photoconductor drum 36.

This makes it possible to suppress damage to the outer peripheral surface of the photoconductor drum 36 even if, when installing the developing device 40 with respect to the photoconductor drum 36, the blocking members 80 and 80A contact the outer peripheral surface of the photoconductor drum 36.

By setting the blocking member 80A on the side of the downstream-side connecting path 72G, the number of cloud particles of the developer in the downstream-side connecting path 72G that is discharged from the opposing surface 72K on the side of the downstream-side connecting path 72G is capable of being reduced.

According to the structure of the exemplary embodiment, compared to the case in which the size of the gap between the opposing surface 72K, which opposes the photoconductor drum 36, and the photoconductor drum 36 is constant in the axial direction, it is possible to reduce the number of cloud particles of the developer that is discharged from the developing device 40.

In addition, compared to the case in which the blocking member 80 is provided on the opposing surface 72K at a position that is displaced from a range in which the upstream-side connecting path 72F is formed, it is possible to reduce the number of cloud particles of the developer that is discharged from the developing device 40.

Further, compared to the case in which the blocking member 80 is provided in only part of the range in which the upstream-side connecting path 72F is formed, it is possible to reduce the number of cloud particles of the developer that is discharged from the developing device 40.

Further, compared to the case in which the blocking member 80 is provided on only the side of the upstream-side connecting path 72F, it is possible to reduce the number of cloud particles of the developer that is discharged from the developing device 40.

Further, compared to the case in which the blocking member 80 is harder than the outer peripheral surface of the photoconductor drum 36, it is possible to suppress damage to the surface of the photoconductor drum 36.

Further, compared to the case in which the opposing surface 72K where the blocking member 80 is not provided on a projecting portion of the blocking plate 82 is used, it is possible to reduce the number of cloud particles of the developer that is discharged from the developing device 40.

Further, compared to a case in which the developing device 40 according to any one of non-limiting embodiments is not used, it is possible to reduce the number of cloud particles of the developer that is discharged from the developing device 40.

Disposition of Blocking Member

Next, a first modification and a second modification regarding the disposition of the blocking member 80 are described.

Figure 8:
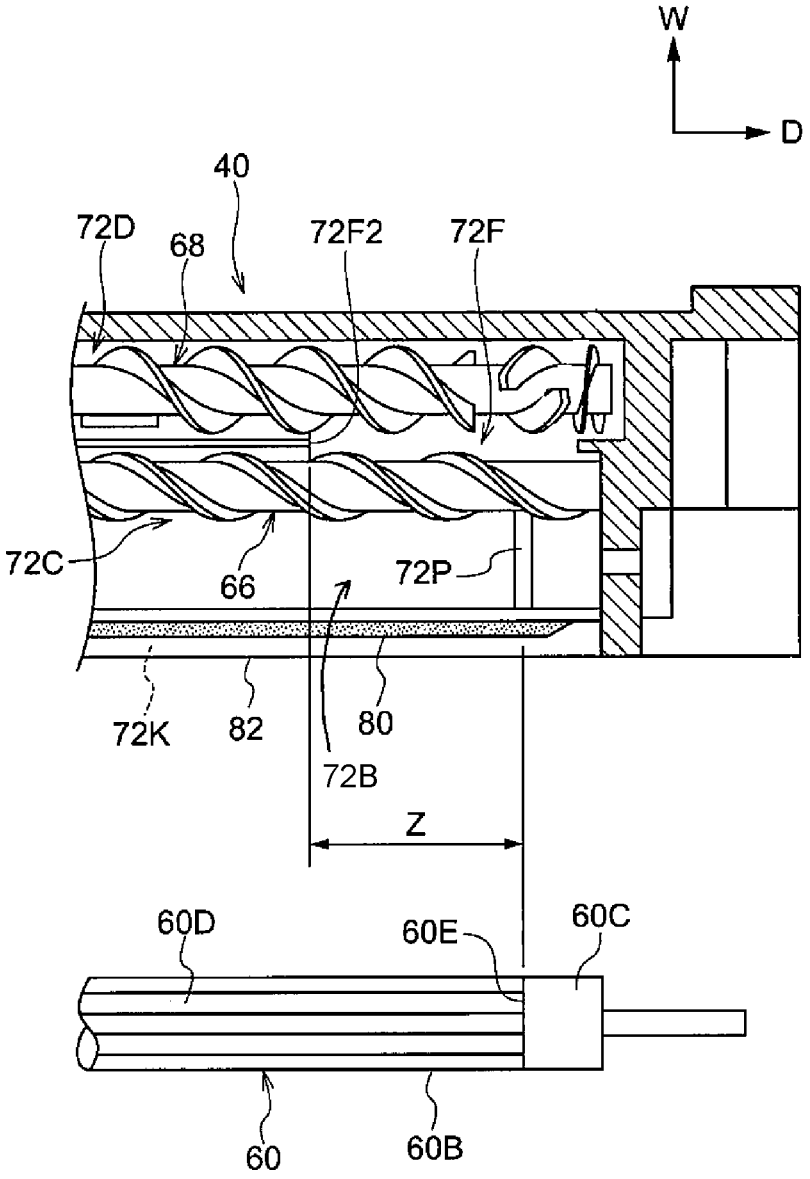
FIG. 8 is a partial sectional plan view of a second modification according to the exemplary embodiment.

In the first modification and the second modification, as shown in FIGS. 7 and 8, the blocking member 80 is disposed on the upstream side of the supply path portion 72C, that is, on the side of the upstream-side connecting path 72F.

First Modification

In the first modification, as shown in FIG. 7, on a side corresponding to the upstream side of the supply path portion 72C in the axial direction of the developing roller 60, the blocking member 80 is provided so as to include a range Y from the upstream wall 72N of the supply path portion 72C to a downstream-side end portion 72F2 defining the upstream-side connecting path 72F.

This includes the entire range in which the upstream-side connecting path 72F is formed.

Therefore, compared to the case in which the blocking member 80 is formed in only part of the range from the upstream wall 72N to the downstream-side end portion 72F2 defining the upstream-side connecting path 72F, it is possible to reduce the number of cloud particles of the developer that is discharged from the developing device 40.

Further, compared to the case in which the blocking member 80 is provided in only part of the range in which the upstream-side connecting path 72F is formed, it is possible to reduce the number of cloud particles of the developer that is discharged from the developing device 40.

Second Modification

In the second modification, as shown in FIG. 8, on the side corresponding to the upstream side of the supply path portion 72C in the axial direction of the developing roller 60, the blocking member 80 is provided so as to include a range Z interposed between the boundary portion 60E of the rotary sleeve 60B and the downstream-side end portion 72F2 defining the upstream-side connecting path 72F.

Therefore, compared to the case in which the blocking member 80 is provided in only part of the range from the boundary portion 60E of the rotary sleeve 60B to the downstream-side end portion 72F2 defining the upstream-side connecting path 72F, it is possible to reduce the number of cloud particles of the developer that is discharged from the developing device 40.

In the exemplary embodiment, a range in which the blocking member 80 is provided may desirably exist in the range Z including the boundary portion 60E of the rotary sleeve 60B and the downstream-side end portion 72F2 defining the upstream-side connecting path 72F.

The range in which the blocking member 80 is provided may more desirably exist in the range X corresponding to part of the range in which the upstream-side connecting path 72F is formed.

The range in which the blocking member 80 is provided may still more desirably exist in the range Y extending from the upstream wall 72N of the supply path portion 72C to the downstream-side end portion 72F2 defining the upstream-side connecting path 72F, or the entire range in which the upstream-side connecting path 72F is formed of the range Y.

Although the present invention is described by way of a specific exemplary embodiment, the present invention is not limited to such an exemplary embodiment. It is obvious to any person skilled in the art that various other exemplary embodiments are possible within the scope of the present invention.

For example, in the exemplary embodiment, the blocking member 80 is positioned on the upstream side of the supply path portion 72C in the axial direction of the developing roller 60, and the blocking member 80A is positioned on the downstream side of the supply path portion 72C in the axial direction of the developing roller 60.

However, only the blocking member 80 may be positioned on the upstream side of the supply path portion 72C in the axial direction of the developing roller 60.

Although the blocking members 80 and 80A are provided on the blocking plate 82, which corresponds to the opposing surface 72K, the blocking members 80 and 80A may be provided on the wall section 72J, which corresponds to the opposing surface 72K, without using the blocking plate 82.

The dimension of the region D3 where the blocking member 80 is not provided is smaller than the size of a smallest sheet P where image formation by the image forming apparatus 10 is guaranteed (guaranteed smallest paper size) among the sizes of sheets P in the axial direction of the developing roller 60 used in image formation.

However, the dimension of the region D3 is not limited thereto. The dimension of the region D3 may obviously be set larger than the size of a smallest sheet P where image formation by the image forming apparatus 10 is guaranteed.

The lengths of the blocking members 80 and 80A in the axial direction of the developing roller 60 may be set as appropriate considering, for example, the model and printing performance (image quality and printing speed) of the image forming apparatus 10.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer holder configured to hold developer, the developer holder being disposed so as to oppose an image holder configured to hold a latent image and develop the latent image with the developer;

a housing that accommodates the developer holder with the developer holder being exposed from an opening portion;

a wall section that is provided over an entire region in an axial direction of the developer holder from an edge portion, which is a downstream side in a rotation direction of the developer holder, of the opening portion of the housing, the wall section having an opposing surface that opposes an outer peripheral surface of the image holder to form a gap; and a blocking member that is disposed on one side of the opposing surface in the axial direction and that blocks part of the gap.

2. The developing device according to claim 1, wherein the housing includes:

a stirring path portion that is formed on one side thereof and where a stirring member is provided;

a supply path portion that is formed on the other side thereof and side by side the stirring path portion, the supply path portion being where a supplying member is provided; and a partition plate that separates the stirring path portion and the supply path portion from each other and is disposed between an upstream-side connecting path and a downstream-side connecting path that connect the stirring path portion and the supply path portion, and wherein in the axial direction the blocking member is provided on the opposing surface in at least part of a range in which the upstream-side connecting path is formed.

3. The developing device according to claim 2, wherein in the axial direction the blocking member is provided on the opposing surface so as to include the range in which the upstream-side connecting path is formed in an entirety thereof.

4. The developing device according to claim 2, wherein the supply path portion includes an upstream wall that defines an end portion that is disposed upstream from the upstream-side connecting path, and wherein in the axial direction the blocking member is provided on the opposing surface so as to include a range from the upstream wall to a downstream-side end portion defining the upstream-side connecting path.

5. The developing device according to claim 2, wherein the developer holder includes non-development portions and a developer holding portion, the non-development portions being formed on two end portions in the axial direction of the developer holder, the developer holding portion being interposed between the non-development portions on the two end portions, and wherein in the axial direction the blocking member is provided on the opposing surface so as to include a range from a boundary portion between the developer holder and the non-development portion on a side of the upstream-side connecting path to the downstream-side end portion defining the upstream-side connecting path.

6. The developing device according to claim 2, further comprising another blocking member that differs from the blocking member and that is provided on a side of the downstream-side connecting path.

7. The developing device according to claim 1, wherein the blocking member is made of an elastic material.

8. The developing device according to claim 1, wherein the wall section includes a blocking plate having a projecting portion that projects from the wall section towards an outer peripheral surface of the developer holder, and wherein the blocking member is provided on the projecting portion of the blocking plate.

9. An assembly body comprising:

an image holder configured have a latent image formed thereon; and the developing device according to claim 1 configured to develop the latent image formed on the outer peripheral surface of the image holder as a toner image, wherein the assembly body is assembled so as to be replaceable as one body with respect to a body of an image forming apparatus.

10. An image forming apparatus comprising:

an image holder;

a charging device configured to charge an outer peripheral surface of the image holder;

a latent image forming device configured to form a latent image on the outer peripheral surface of the image holder charged by the charging device;

the developing device according to claim 1 configured to develop the latent image as a toner image; and a transfer device configured to transfer the toner image to a transfer body.

* * * * *